US008567148B2

(12) United States Patent
Gentil

(10) Patent No.: US 8,567,148 B2
(45) Date of Patent: Oct. 29, 2013

(54) DEVICE FOR CONNECTING PREFABRICATED CONCRETE SECTIONS

(75) Inventor: Hugo Gentil, Marburg (DE)

(73) Assignee: Peikko Group Oy, Lahti (FI)

( * ) Notice: Subject to any disclaimer, the term of this patent is extended or adjusted under 35 U.S.C. 154(b) by 107 days.

(21) Appl. No.: 12/722,557

(22) Filed: Mar. 12, 2010

(65) Prior Publication Data

US 2010/0229490 A1 Sep. 16, 2010

(30) Foreign Application Priority Data

Mar. 12, 2009 (EP) ..... 09003587

(51) Int. Cl.
*E04B 1/48* (2006.01)
*E04B 2/84* (2006.01)

(52) U.S. Cl.
USPC ..... 52/585.1; 52/98; 52/122.1; 52/584.1; 52/587.1; 52/714; 403/12; 403/291

(58) Field of Classification Search
USPC ..... 52/585.1, 714, 584.1, 587.1, 583.1, 52/122.1, 125.2, 125.3, 125.4, 125.5, 52/125.6, 704, 707, 98, 99, 143; 294/89; 403/12, 33, 269, 291
See application file for complete search history.

(56) References Cited

U.S. PATENT DOCUMENTS 2,955,338 A * 10/1960 Gough ..... 403/268
3,310,333 A * 3/1967 Hutson ..... 294/82.11
3,512,223 A * 5/1970 Willinger ..... 403/209
3,579,931 A * 5/1971 Lang ..... 52/745.21
3,652,118 A * 3/1972 Goldberg ..... 294/89
3,702,709 A * 11/1972 Shaffer ..... 403/158
3,705,469 A * 12/1972 Eriksson ..... 52/125.4
3,782,220 A * 1/1974 Ditlinger ..... 74/579 R
3,832,817 A * 9/1974 Martens ..... 52/583.1
3,932,697 A * 1/1976 Hood ..... 174/79
4,043,690 A * 8/1977 Browne ..... 403/268
4,111,401 A * 9/1978 Pickett ..... 256/13.1
4,150,906 A * 4/1979 Bernard ..... 403/213
4,290,246 A * 9/1981 Hilsey ..... 52/169.1
4,498,271 A * 2/1985 Koniger et al. ..... 52/707
5,033,169 A * 7/1991 Bindon ..... 24/129 R
5,899,043 A * 5/1999 Reay ..... 52/707

(Continued)

FOREIGN PATENT DOCUMENTS

CA 2692365 C * 10/2012
DE 3322646 A1 * 3/1984

(Continued)

OTHER PUBLICATIONS

Machine Translation for DE 3322646 A1 (5 pages).*

(Continued)

*Primary Examiner* — Basil Katcheves
*Assistant Examiner* — Rodney Mintz
(74) *Attorney, Agent, or Firm* — Panitch Schwarze Belisario & Nadel LLP

(57) ABSTRACT

A device is provided for joining pre-cast concrete sections, the device including a cable loop, wherein the cable sections forming bent portions of the cable loop have sleeves for keeping the cable sections in a bent-over position. The sleeves are plastically deformable before bending and surround the bent portions of the cable sections, but the material of the sleeves is such that the sleeves break under return deformation.

9 Claims, 3 Drawing Sheets

(56) References Cited

U.S. PATENT DOCUMENTS

| | | | | |
|---|---|---|---|---|
| 6,102,607 | A * | 8/2000 | Kintscher | 403/291 |
| 6,308,478 | B1 * | 10/2001 | Kintscher et al. | 52/223.7 |
| 6,543,977 | B2 * | 4/2003 | Sander et al. | 411/82.1 |
| 6,786,020 | B2 * | 9/2004 | Poldmaa | 52/704 |
| 7,296,382 | B2 * | 11/2007 | Sack | 52/125.5 |
| 7,395,635 | B2 * | 7/2008 | Neef et al. | 52/125.4 |
| 7,857,540 | B2 * | 12/2010 | Ruel et al. | 403/208 |
| 7,930,863 | B1 * | 4/2011 | Fyfe | 52/582.1 |
| 8,256,200 | B2 * | 9/2012 | Nuesch | 57/237 |
| D672,630 | S * | 12/2012 | Talley et al. | D8/300 |
| 8,387,328 | B2 * | 3/2013 | Gentil | 52/587.1 |
| 2003/0140575 | A1 * | 7/2003 | Sanftleben et al. | 52/125.4 |
| 2003/0140576 | A1 * | 7/2003 | Sanftleben | 52/125.4 |
| 2004/0168375 | A1 * | 9/2004 | Sack | 52/125.4 |
| 2005/0210771 | A1 * | 9/2005 | Kuenzel | 52/155 |
| 2005/0257445 | A1 * | 11/2005 | Neef et al. | 52/125.2 |
| 2006/0103110 | A1 * | 5/2006 | Nuesch | 280/457 |
| 2007/0080331 | A1 * | 4/2007 | Roth | 256/12.5 |
| 2007/0126249 | A1 * | 6/2007 | Leach | 294/1.1 |
| 2007/0164575 | A1 * | 7/2007 | Leach | 294/1.1 |
| 2009/0199493 | A1 * | 8/2009 | Kintscher | 52/122.1 |
| 2010/0064654 | A1 * | 3/2010 | Nuesch | 57/237 |
| 2010/0251656 | A1 * | 10/2010 | Gentil | 52/587.1 |
| 2012/0240483 | A1 * | 9/2012 | Sladojevic | 52/125.4 |
| 2012/0279145 | A1 * | 11/2012 | Sladojevic | 52/125.4 |
| 2012/0304554 | A1 * | 12/2012 | Sladojevic | 52/125.4 |

FOREIGN PATENT DOCUMENTS

| | | | |
|---|---|---|---|
| DE | 3322646 | C2 | 7/1985 |
| DE | 10225699 | B3 | 4/2004 |
| DE | 20319471 | U1 | 1/2005 |
| DE | 20 2007 011 243 | U1 | 10/2007 |
| EP | 0534475 | A1 | 3/1993 |
| EP | 1637670 | A1 | 3/2006 |
| WO | 9631671 | A1 | 10/1996 |
| WO | WO 2007074212 | A1 * | 7/2007 |
| WO | WO 2008090260 | A1 * | 7/2008 |
| WO | WO 2012175802 | A1 * | 12/2012 |

OTHER PUBLICATIONS

Bibliographic data and complete copy of DE 3322646 C2 obtained from Espacenet.com (last visited Mar. 5, 2013), 7 pages total.*

* cited by examiner

DEVICE FOR CONNECTING PREFABRICATED CONCRETE SECTIONS

BACKGROUND OF THE INVENTION

The present invention relates to a device for joining pre-cast (prefabricated) concrete sections, the device comprising a cable loop, wherein the cable sections forming the loop have means for keeping the cable sections in a bent-over position. The invention also relates to a pre-cast concrete section having a device of the kind described above.

Devices of the kind having a cable loop for joining pre-cast concrete sections, particularly prefabricated wall elements of concrete, are well-known from the prior art. Devices of this kind usually comprise a retaining part in the form of a rail, which is of U-shaped construction and which at the end is led into the pre-cast concrete section. It is necessary for transport and also during mounting of such a pre-cast concrete section that the cable loop substantially does not protrude beyond the edge face. To that extent it has to be achieved that the cable loop is received by the retaining part, i.e. substantially does not protrude beyond the retaining part.

In this connection, various devices are known from the prior art, which in principle do justice to this premise. Thus, for example, a receiving box is known from European patent application publication EP 1 637 670 A1, which has a removable cover, wherein the cable loop, which projects through an opening on the rear side of the receiving box, is held under stress against the removable cover by a spreading spring during transport and also during mounting. When the cover is removed, the cable loop shoots forward, not only due to the bias through the spreading spring but also due to the resilient characteristics of the cable loop, and goes over, for example in the case of an upright wall section, into an approximately horizontal position. That means the cable loop extends in the direction of the edge face of the opposite pre-cast concrete section.

The outlay which is necessitated in accordance with the prior art, in order to keep the cable loop during transport and mounting in a state bent over by approximately 90° and thus parallel to the upper side of the pre-cast concrete section, is high, and for that reason such devices are also very expensive.

Moreover, a device is known from European Patent EP 0 914 531 B1, which similarly comprises a U-shaped retaining part, which has on the rear side a passage opening for the cable loop, wherein the retaining part is of approximately U-shaped construction and wherein the limbs are bent over inwardly at the end. The cable loop now projects by its loop-shaped end through the opening, which is arranged on the rear side, in the retaining part and bears from within against the bent-over portions of the limbs of the retaining part. After mounting, the cable loop is pulled out of the retaining part by the loop-shaped end, whereby the cable loop snaps up.

German utility model DE 20 2007 011 243 U1 shows a similar construction insofar as a shaped part is provided there for fixing the cable loop, which shaped part has a mechanically positive couple with the section, which forms the bent-over cable eye, of the cable on at least three sides and which shaped part, after casting of the concrete pre-cast concrete section, may be withdrawn from the concrete pre-cast section and the cable eye.

In this connection, the outlay for keeping the cable loop in the bent-over state is relatively high, particularly because a specially constructed rail has to be produced as a retaining part, and in addition, the cable loop in the transfer to the pre-cast concrete section is kept by an insert body in the opening of the retaining part. This device is thus also comparatively expensive.

Finally, a device is known from European Patent EP 0 534 475 B1, in which an insert dish part is provided as well as a cover, wherein the insert dish part receives the cover by means of a snap connection. The loop-shaped end is kept parallel to the edge face of the pre-case concrete section by the insert dish part in conjunction with the cover. It is also the case here that production of such a device is complicated and costly.

A cable transport anchor having a loop at the end is known from German published patent application DE 33 22 646 A1. The guiding together and bending over of central cable regions are carried out by a guiding and bending-over device which is formed by a sleeve.

BRIEF SUMMARY OF THE INVENTION

The object of the invention thus resides in producing a device of the kind stated in the introduction which is particularly economical to manufacture, but nevertheless reliably fulfils the same purpose as the prior art. In this connection reference is made to the following:

The cable loop projects, as already mentioned, by its loop-shaped end after mounting towards the edge face of the opposite pre-cast concrete section. The cable loop is disposed with its other end in the pre-cast concrete section. Once the cable loop is released, i.e. has been freed from its bent-over position, it is not necessary for the cable loop to be transferred back to this starting position, but it merely has to be ensured that during transport and during mounting the cable loop remains in the bent-over position.

Taking this into consideration, the device according to the invention is distinguished by the fact that the cable sections forming the loop comprise means to keep the cable sections in a bent-over position, wherein the means for keeping the cable loop in a bent-over position are plastically deformable sleeves which grip the cable of the cable section of the cable loop in the region thereof in which the bend of the cable loop is provided. In this regard, the material of the sleeves is such that the sleeves break on return deformation. To that extent, there can be provided for the sleeve, in particular, a plastic material which surrounds the cable section in sleeve-like manner in order to then bend the sleeve, including the cable section extending therein, by a suitable device through the desired angle of approximately 90°. If the cable loop is then bent back, the sleeve breaks, which allows the cable loop to erect by virtue of its resilient properties.

According to a variant of this embodiment, the sleeve comprises a strap which has at each end a respective bendable wing for engaging around the cable of a cable section of the cable loop. In this connection, the strap is advantageously constructed to be curved parallel to the longitudinal axis of the strap and has a notch in the region of the bending-over of the cable loop. Advantageously, in this variant it is further provided that the notch extends over a substantial part of the width of strap, wherein the strap halves are connected on both sides of the notch by webs. The following results therefrom: The strap embraces the cable of the cable section at its circumference only over a small part (part circumference), wherein the part circumference is less than half the full circumference relative to the cross-section of the cable of the cable section of the cable loop. By the introduction of a notch in the strap in the region of the bending-over of the cable loop after the bending-over procedure, the sleeve is broken in the region of the webs, which connect the two strap halves, when the cable loop is bent back. This means that the webs connecting the two strap halves are to be so dimensioned that they can keep the cable loop in the bent state, but after bending back from the 90° angle to a horizontal position the webs break.

As was already explained, a sleeve of plastics material can serve this purpose, but also a sleeve of metal, wherein the metal is constructed to be of such brittleness that the webs actually break during bending back of the loop. From this it is clear that the cable sections forming the loop are kept in their bent-over position by means which are in direct connection with the cable loop itself or are part of the cable loop. This is in complete contrast to the prior art, where in each instance a separate device is required in order to keep the cable loop in the bent-over position merely for transport and mounting. Since those separate devices are omitted, such a cable loop can be produced substantially more economically. In particular, to that extent the possibility also now exists of directly letting, or concreting in place, the cable loop in the edge face of a pre-cast concrete section, since—as already mentioned—separate devices for keeping the cable loop in a bent-over position during transport and during mounting are no longer required.

According to a further feature of the invention, provision is made for the cable loop to have an insert body, wherein the insert body has at least one opening for the cable loop. The insert body is, in particular, constructed to be of U-shaped profile in cross-section, wherein the web connecting the two limbs of the insert body of U-shaped profile has the opening for the cable loop. The cable loop projects with its closed end through this opening, whereby this end is also cast in place in the pre-cast concrete section. The cable loop lies with its bent-over loop-shaped end in the rail of U-shaped profile in cross-section.

The invention further includes a pre-cast concrete section, particularly a wall element of pre-cast concrete, which is distinguished by at least one device of the type described above. In detail, it is provided in this connection that the insert body is inserted at and edge of the pre-cast concrete section in such a manner that the front edge of the insert body is flush with the edge surface of the concrete section. It is clear from this that by having the insert body set back relative to the edge face, a denticulation with the casting mortar occurs during filling of the casting gap. The connection is thereby in a position to accept shearing forces. On the other hand, one or more reinforcing rods is or are pushed through the cable loops which overlap one another as a pair in such a manner that an eye results, whereby forces also acting in longitudinal direction of the cable loops can be accepted by the cable loops.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
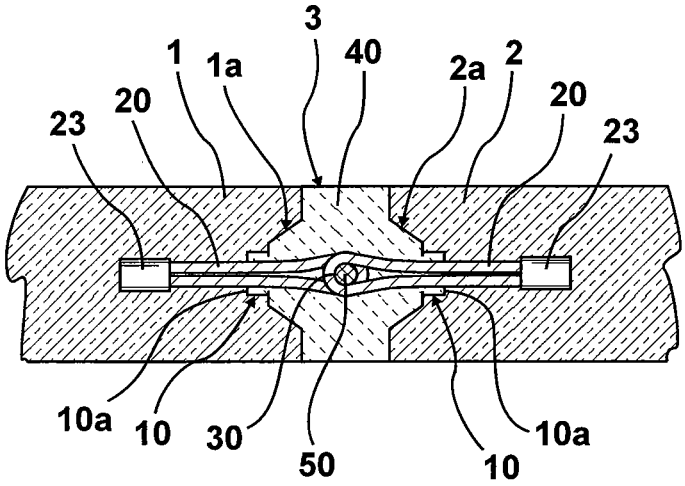
FIG. 1 is a schematic, end cross-sectional view showing edge portions of two pre-cast concrete sections which, spaced from one another, form a joint.

The two pre-cast concrete sections 1 and 2 according to FIG. 1 are disposed at a spacing from one another with formation of a joint 3. The pre-cast concrete sections 1 and 2 each have a trapezoid-shaped recess 1*a* or 2*a* at the edge face, wherein provided in the base of the trapezoid-shaped recess 1*a* is an insert body 10 which is recognizably constructed to be of U-shaped profile in cross-section. The insert body 10 is cast in place, with surface flushness, in the edge face of the respective wall section 1 or 2. The web 10*a* of the insert body of U-shaped profile has a passage opening 10*b* for the cable loop, which is designated overall by 20. The ends of the cable loop 20 are connected together by a pressed member 23, wherein this part of the cable loop is cast in place in the concrete of the pre-cast concrete section, just as is the insert body 10. The cable loop 20 overlaps the adjacent cable loop, wherein the eye 30 thereby formed receives a reinforcing rod 50. The joint 3 is then filled with casting mortar 40.

Figure 2:
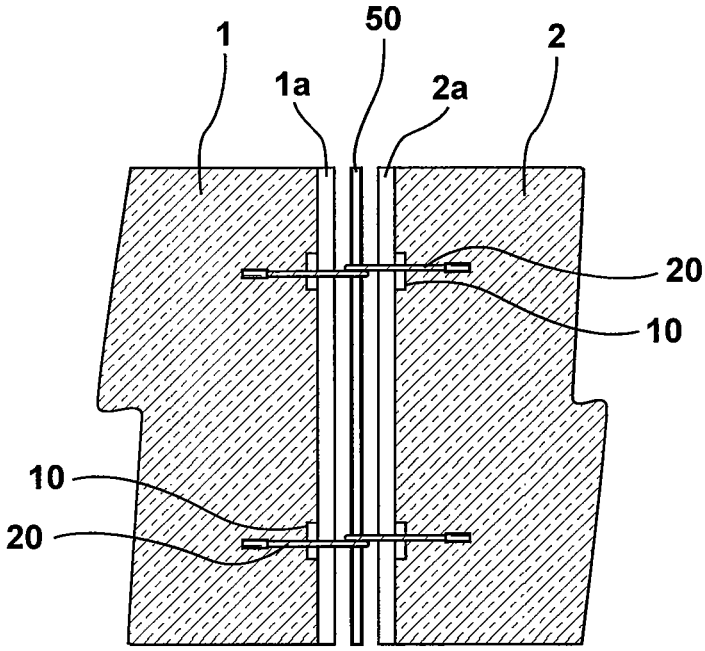
FIG. 2 is schematic, side cross-sectional view of the joint according to FIG. 1.

A side illustration of two pre-cast concrete sections connected together is evident from FIG. 2.

Figure 3:
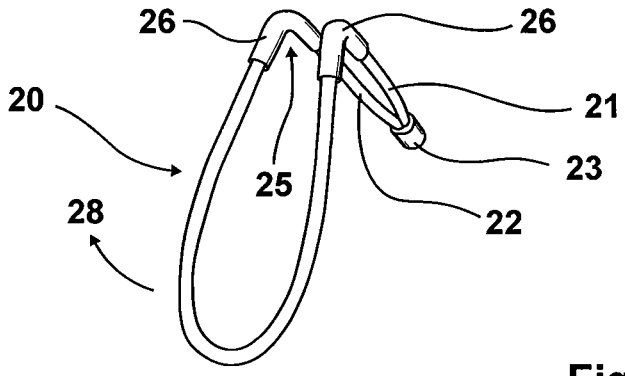
FIG. 3 is a perspective view of a first embodiment of the cable loop according to the invention, having a first sleeve in bent-over position.

The cable loop 20 in the bent-over state of the loop-shaped end is illustrated according to in FIG. 3. In this connection the two cable sections 21 and 22, which in the region of the bent-over portion (arrow 25) each receive a sleeve 26, are apparent. The sleeve is made, for example, of plastic material and is configured in such a manner that it breaks when the cable loop 20 is bent up in the direction of the arrow 28.

Figure 6:
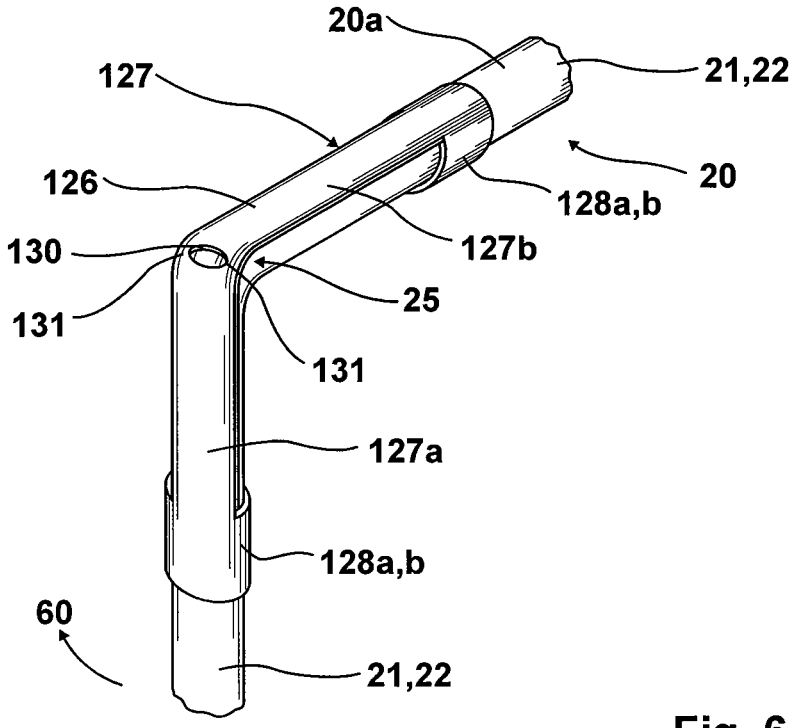
FIG. 6 is a perspective view of a second embodiment of the cable loop according to the invention, having a second sleeve shown in bent-over position.
Figure 6A:
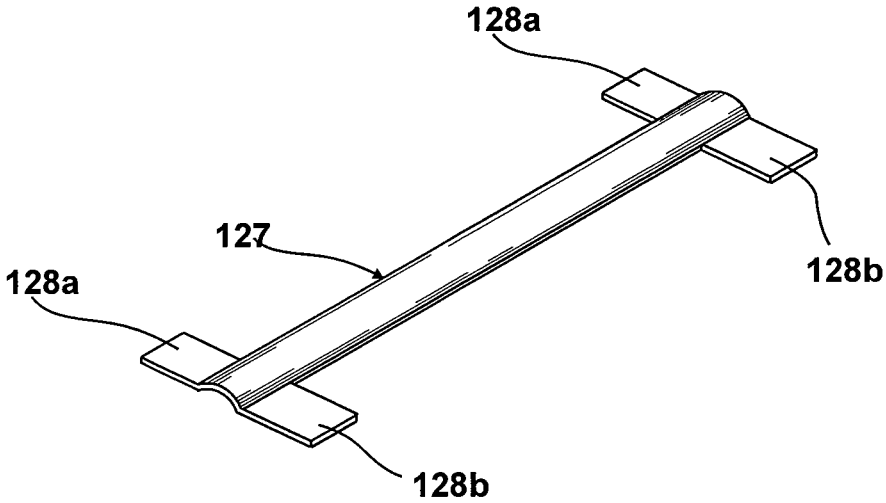
FIG. 6*a* is a perspective view of the sleeve of FIG. 6 shown in flattened out state before application to a cable loop.

In the embodiment of the sleeve according to FIGS. 6 and 6*a* the sleeve is denoted by 126, wherein the sleeve comprises a strap 127, which is provided at each of the two ends with two wings 128*a*, 128*b*. The sleeve 126 is fixed on the cable 20 of the respective cable section 21, 22 on either side of the bend or bent-over portion by the wings 128*a*, 128*b*. The two wings 128*a*, 128*b* are connected together by the strap 127. A notch 130 is located in the strap 127 in the region of the bend of the cable sections 21, 22 (arrow 25). The lateral extent of the notch 130 is such that on either side of the notch a web 131 is left which connects the two strap halves 127*a* and 127*b* together. If the cable loop is bent straight again, the webs 131 break.

In the initial state the strap 127 of the sleeve 126 has at each end two protruding wings 128*a*, 128*b*. After bending of the strap 127 or the sleeve 126 the notch 130 is formed in the region of the bend. Webs 131 remain on either side of the notch 130. The sleeve is fastened to the cable loop by the wings. The sleeve 126 thus looks after bending-over of the cable loop for the purpose of transport, as was already explained. If the cable loop is bent back (arrow 60) the webs 131 on both sides of the notch 130 break. The cable loop is then ready for mounting.

Figure 4:
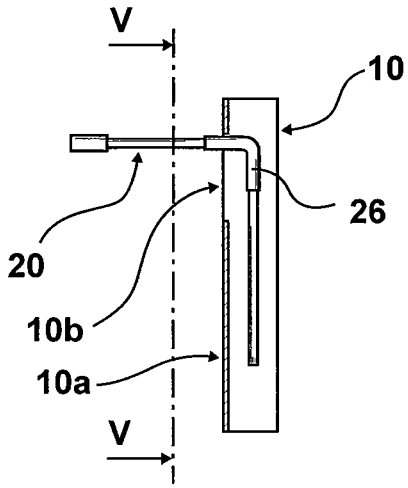
FIG. 4 is a side view of the cable loop according to FIG. 3 with an insert body.
Figure 5:
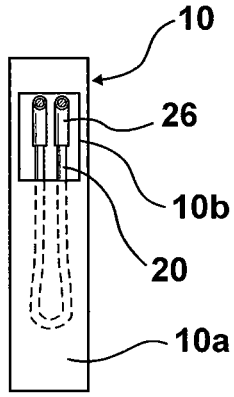
FIG. 5 is a view of the cable loop and insert body taken along the line V-V of FIG. 4.

The insert body 10 with a cable loop 20 in bent-over state is depicted in the illustration according to FIG. 4. The insert body 10, which is constructed to be of a U-shaped profile, has an opening 10*b* on its rear side (FIG. 5). The insert body can be used with either of the two embodiments of the sleeve (26, 126) described above.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A device for joining pre-cast concrete sections, the device comprising:

a cable loop having cable sections forming bent portions of the cable loop; and a sleeve surrounding at least one of the bent portions of the cable loop and maintaining the at least one bent portion in a bent-over position at an angle of approximately 90° at least for a period after pre-casting in a precast concrete section and during transportation and storage of the concrete section by the sleeve, wherein the sleeve comprises a material which is plastically deformable before bending the cable sections and sleeve, but which breaks under return deformation of the cable sections and sleeve, and wherein the sleeve comprises a strap having at each end two protruding wings for engaging around portions of cable sections of the cable loop.

2. The device according to claim 1, wherein the strap has a form of a strip curved parallel to a longitudinal axis of the strap and has a notch in a region of the bent-over cable loop.

3. The device according to claim 2, wherein the notch extends over a substantial part of a width of the strap, and wherein end halves of the strap are connected on either side of the notch by a web.

4. The device according to claim 2, wherein the notch is formed in the strap in the bent state of the strap.

5. The device according to claim 1, wherein the sleeve comprises a metal.

6. A device for joining pre-cast concrete sections, the device comprising:

a cable loop having cable sections forming bent portions of the cable loop;

an insert body insertable into a recess of a pre-cast concrete section, the insert body having a U-shaped profile and at least one opening for the cable loop, a portion of the cable loop which extends from the pre-cast concrete section lying in a channel of the U-shaped profile of the insert body in a bent-over position; and a retainer configured to keep the portion of the cable loop in the bent-over position, the retainer being formed as a tubular sleeve completely surrounding at least one of the bent portions of the cable loop, the sleeve retaining the at least one bent portion in the bent-over position at an angle of approximately 90° at least for a period after pre-casting in the pre-cast concrete section and during transportation and storage of the pre-cast concrete section, wherein the sleeve comprises a plastic material which is plastically deformable before bending the cable sections and sleeve, but which breaks under return deformation of the cable sections and sleeve.

7. A pre-cast concrete section comprising a device according to claim 6, wherein the cable loop has a loop-shaped end, which for joining to another pre-cast concrete section projects towards an opposite edge face of the other pre-cast concrete section, and a pressed end embedded in an edge portion of the pre-cast concrete section.

8. The pre-cast concrete section according to claim 7, wherein the insert body has a U-shaped profile and is inserted into a recess of the pre-cast concrete section such that an open front edge of the U-shaped profile is flush with a surface of an edge face of the pre-cast concrete section.

9. The pre-cast concrete section according to claim 7, wherein the concrete section is a wall element.

* * * * *